US006102032A

United States Patent [19]

Sebby et al.

[11] Patent Number: 6,102,032

[45] Date of Patent: Aug. 15, 2000

[54] FIRE LOG ARRANGEMENT

[76] Inventors: David A. Sebby; Eunice J. Sebby, both of 7238 Bell Rd., Knoxville, Tenn. 37918

[21] Appl. No.: 09/165,466

[22] Filed: Oct. 2, 1998

[51] Int. Cl.[7] ..... F23H 13/00; F23H 17/08

[52] U.S. Cl. ..... 126/501; 126/540; 126/152 R; 126/152 B

[58] Field of Search ..... 431/125; 126/500, 126/501, 512, 152 R, 152 B, 540, 541, 552, 298

[56] References Cited

U.S. PATENT DOCUMENTS

| | | | |
|---|---|---|---|
| 2,762,362 | 9/1956 | Neilson | 126/92 R |
| 3,042,109 | 7/1962 | Peterson | 431/125 |
| 3,377,229 | 4/1968 | Bryan | 431/125 |
| 4,886,445 | 12/1989 | Richardson | 431/125 |
| 5,067,476 | 11/1991 | Rhodes, Jr. et al. . | |
| 5,118,539 | 6/1992 | Sebby et al. . | |
| 5,137,012 | 8/1992 | Crossman, Jr. et al. | 126/501 |
| 5,435,295 | 7/1995 | Gerrard | 126/541 |
| 5,839,427 | 11/1998 | Shorts | 126/512 |

FOREIGN PATENT DOCUMENTS

| | | | |
|---|---|---|---|
| 609032 | 2/1935 | Germany | 126/500 |

*Primary Examiner*—Carl D. Price
*Attorney, Agent, or Firm*—Pitts & Brittian, P.C.

[57] ABSTRACT

A fire log arrangement for use in conjunction with a combustible fuel source and influences complete combustion of the combustible fuel. The fire log arrangement includes a first log and a second log. The first log and the second log define an interior face. The second log is spaced apart from the first log such that a fuel space is defined therebetween. The fuel space receives the combustible fuel therein and defines a fire chamber at a lower end thereof. The first log interior face and the second log interior face cooperate to induce the combustible fuel to fall inward between the first log and the second log thereby inducing a thorough combustion of the combustible fuel.

13 Claims, 3 Drawing Sheets

FIRE LOG ARRANGEMENT

TECHNICAL FIELD

This invention relates to the field of noncombustible fire logs and more specifically to an arrangement for burning combustible fuel.

BACKGROUND ART

The use of fireplaces is widespread because of the comfort, heat and entertainment they provide. The expense of firewood, the inconvenience of chopping one's own wood, retrieving wood when the fire bums down and stoking the fire are some of the drawbacks of wood burning fireplaces. Further, when burning wood, the combustion of the wood is often incomplete and large pieces of unburned wood fall below the grate and remain unburned.

In recent years several alternatives to burning wood which simulate burning wood have been developed. For example, gas in combination with artificial noncombustible logs is a popular alternative because its easy to use. Specifically, the fire is controlled by the turn of a gas knob and, because gas is the fuel consumed, there are no resulting ashes which must be cleared out of the fireplace. A disadvantage with the use of gas is it can be hazardous. Further, the flame produced by burning gas is usually limited in height and defines a finger-like configuration as opposed to the sheet-like configuration of burning wood.

Combustible simulated logs have also become popular but do not provide the same atmosphere of a stack of burning logs.

Therefore, it is an object of the present invention to provide a fire log arrangement which can be used in conjunction with a combustible fuel source such as wood.

It is another object of the present invention to provide a fire log arrangement which saves fuel by influencing complete combustion of the combustible fuel.

Further, it is an object of the present invention to provide a fire log arrangement configured such that the requirement to stoke or tend the fire is minimal.

It is yet another object of the present invention to provide a fire log arrangement which provides efficient fuel consumption.

Moreover, it is an object of the present invention to provide a fire log arrangement wherein the fire is surrounded by a noncombustible material to provide a safer arrangement.

DISCLOSURE OF THE INVENTION

Other objects and advantages will be accomplished by the present invention which provides a fire log arrangement which can be used in conjunction with a combustible fuel source and influences complete combustion of the combustible fuel. The fire log arrangement is comprised of a first log and a second log. The first log and the second log define an interior face. The second log is spaced apart from the first log such that a fuel space is defined therebetween. The fuel space receives the combustible fuel therein and defines a fire chamber at a lower end thereof The first log interior face and the second log interior face cooperate to induce the combustible fuel to fall inward between the first log and the second log thereby inducing a thorough combustion of the combustible fuel.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
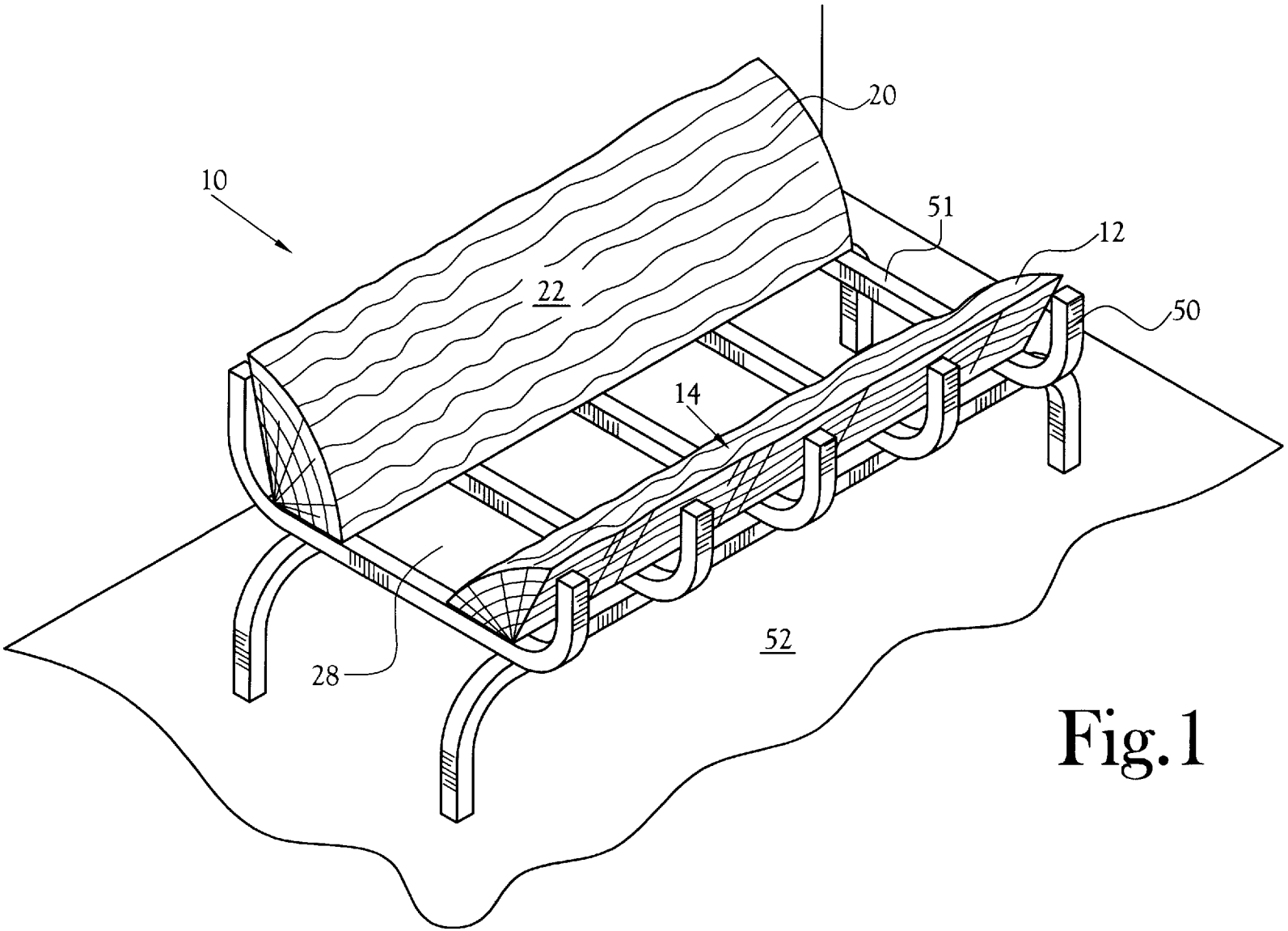
FIG. 1 is a perspective view of the fire log arrangement constructed in accordance with several features of the present invention.

A fire log arrangement incorporating various features of the present invention are illustrated generally at 10 in the figures. The fire log arrangement 10 is designed to be used in conjunction with a combustible fuel source such as wood. Moreover, in the preferred embodiment, the fire log arrangement 10 is designed to save fuel by influencing complete combustion of the combustible fuel source. Further, the fire log arrangement is designed such that the requirement to tend or stoke the fire, once burning, is minimal. Also, the fire log arrangement 10 provides efficient fuel consumption and the fire is surrounded by a noncombustible material.

The fire log arrangement 10 of the present invention includes a first log 12 and a second log 20 which are disposed in a spaced apart and parallel manner such that a fuel space 28 for receiving combustible fuel 54 therein is defined between the first log 12 and the second log 20. A fire chamber 30 is defined at lower end of the fuel space 28. Each log 12, 20 defines an interior face 14, 22. The first log 12 and the second log 20 are positioned such that the respective interior faces 14, 22 are directed toward one another. In the embodiments illustrated in the figures the interior face 14, 22 of each log 12, 20 is convex in configuration. In the illustrated embodiment, the second log 20 is larger than, or more specifically extends above, the first log 12. In the preferred embodiment, the logs 12, 20 are fabricated from a noncombustible material, preferably a ceramic material. It will be noted that a slow burning material may also be used. Moreover, in the preferred embodiment, each log 12, 20 defines an exterior appearance which simulates wood. It will be noted that the ceramic material, when hot, glows in a manner that imitates an actual piece of burning wood.

Figure 2:
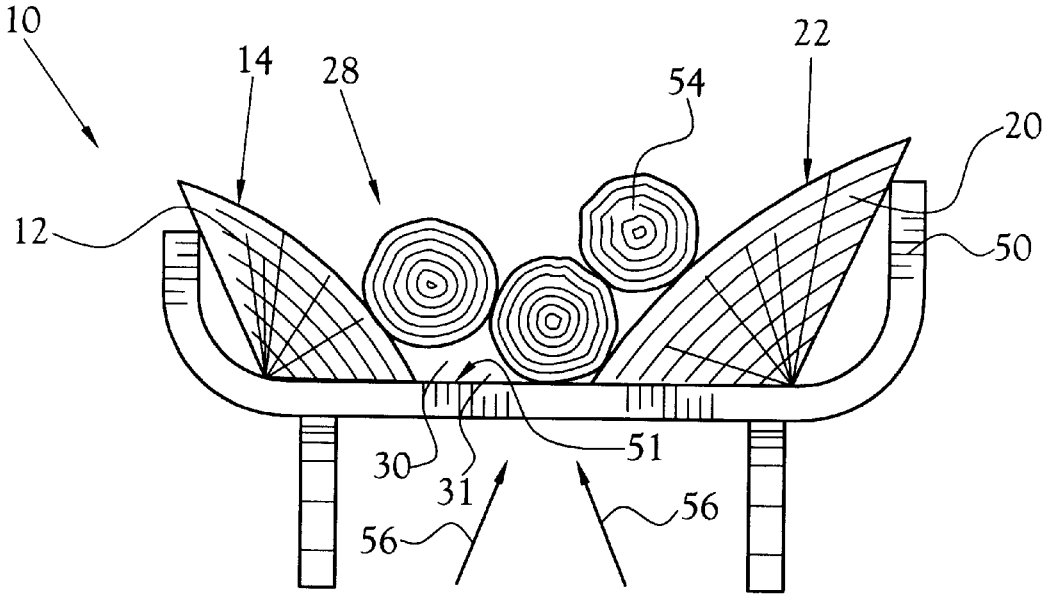
FIG. 2 illustrates a side view of the fire log arrangement with wood logs positioned therebetween.

The fire log arrangement 10 is typically employed in a conventional fireplace whether that fireplace is in a residential home, business or outdoor park, for example. Further, it will be noted that the fire log arrangement 10 can be used without a fireplace such as in a campfire. In the preferred embodiment, the fire log arrangement 10 is positioned on the support surface 51 of a conventional fireplace grate 50, as shown in FIG. 1, such that the arrangement 10 is suspended above the fireplace floor 52. Further, when the logs define two different sizes, it is preferable to position the larger or higher extending log 20 in the rear of the fireplace. FIG. 2 illustrates combustible fuel 54, in this case wood logs, received in the fuel space 28 between the first log 12 and second log 20.

The fire chamber 30 defined at the lower end of the fuel space 28 serves to burn the combustible fuel 54 placed in the fuel space 28. Specifically, the ceramic material of the first and second logs 12, 20 reflects heat into the center of the fire chamber 30 and thus to the fuel 54 positioned between the first 12 and second logs 20. When the fire logs 12, 20 are positioned in a grate 50, the combination of the airflow, indicated by the arrow 56, through the bottom of the grate 50 and the reflection of heat by the first log 12 and second log 20 cooperate to maintain intense heat in the fire chamber 30 such that complete combustion of the combustible fuel 54 is induced.

The interior faces 14, 22 of the first 12 and second logs 20 are configured to cooperate to define a hopper-like configuration such that the combustible fuel 54 is induced to fall inward between the first log 12 and the second log 20. More specifically, fuel 54 received in the fuel space 28 between the first and second logs 12, 20 is directed toward the fire chamber 30 via gravity and the hopper-like configuration of the first and second logs 12, 20. With this configuration, the fire will rarely, if at all, need to be tended, except to place new fuel on the fire. It will be noted that, although the embodiments in the figures illustrate the interior faces 14, 22 as convex in configuration, the invention is not limited to this configuration. Specifically, the interior faces can define a straight angle or a concave configuration, as well as any other configuration, as long as the configuration is such that the interior faces cooperate to induce the combustible fuel therebetween to fall inward between the first 12 and second log 20.

Figure 3:
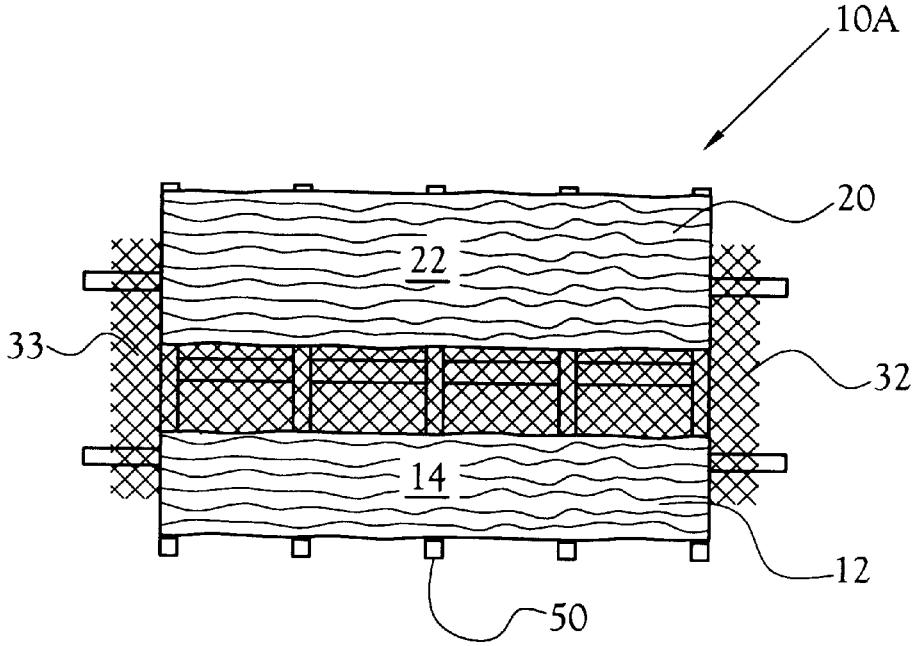
FIG. 3 is a top view of an alternate embodiment of the fire log arrangement of the present invention.

In an alternate embodiment illustrated in FIG. 3, the fire log arrangement 10A further includes a screen 32 which is supported on the support surface 51 of the grate 50 and more specifically, at the base 31 of the fire chamber 30. The screen 32 defines small openings 33 which permit airflow 56 therethrough. The small openings 33 of the screen 32 serve to retain unburned fuel in the fuel space 28 and more specifically, in the fire chamber 30 such that smaller pieces of fuel are prevented from falling from the grate 50 onto the fireplace floor 52 until they are combusted. In the illustrated embodiment, the screen 32 defines a size such that the first and second logs 12, 20 rest on the screen 32. It will be noted that the size of the screen 32 need only be such that it extends between the interior faces where they rest at the support surface 51 of the grate 50. Further, in an alternate embodiment, the screen is secured to the first log 12 and second log 20.

Figure 4:
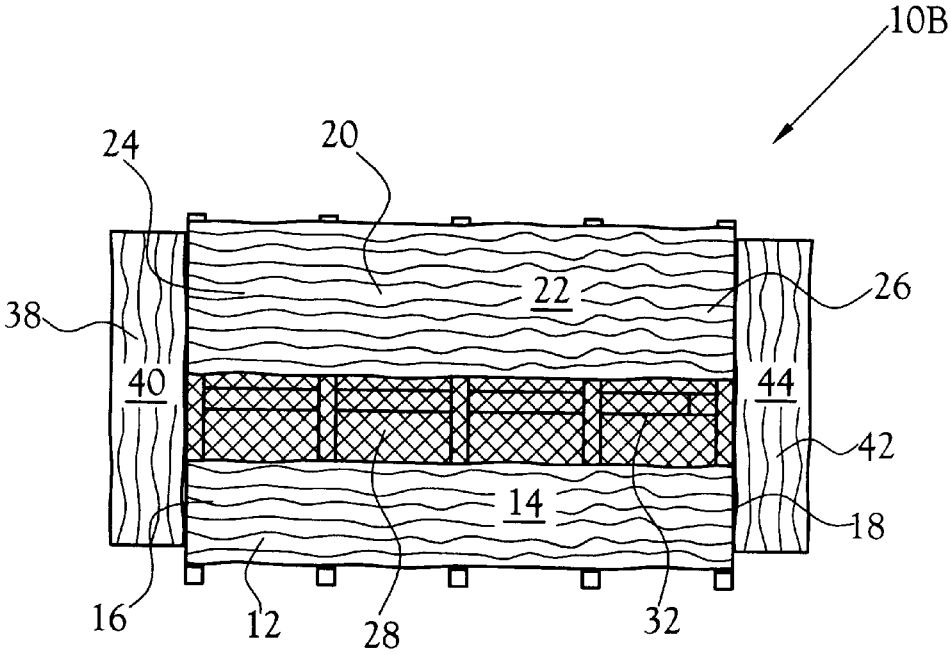
FIG. 4 illustrates a top view of an alternate embodiment of the fire log arrangement of the present invention.

In an alternate embodiment illustrated in FIG. 4, the fire log arrangement 1 OB includes a third log 38 and fourth log 42 which are configured to rest at respective ends of the first log 12 and second log 20. More specifically, the third log 38 rests at a first end 16 of the first log 12 and a first end 24 of the second log 20 and the fourth log 42 rests at a second end 18 of the first log 12 and a second end 26 of the second log 20. The third log 38 and fourth log 42 also define interior faces 40, 44 which contribute to the hopper-like configuration such that combustible fuel 54 resting against these logs 38, 42 will be directed to the fire chamber 30 between the first log 12 and second log 20 via gravity. It will be noted that, although the embodiments in the figures illustrate the interior faces 40, 44 as convex in configuration, the invention is not limited to this configuration. Specifically, the interior faces 40, 44 can define a straight angle or a concave configuration as long as the configuration is such that the interior faces cooperate to induce the combustible fuel therebetween to fall inward between the first 12 and second log 20. It is preferable to utilize the third and fourth logs 38, 42 when small sized fuel is to be burned. Also, the third and fourth logs 38, 42 serve to prevent fuel 54 from dropping out from the sides when the fire log arrangement 10 rest on a fireplace grate 50. It will be noted that although a screen 32 is illustrated in FIG. 4, the third and fourth logs 38, 42 can be used without the screen 32.

Figure 5:
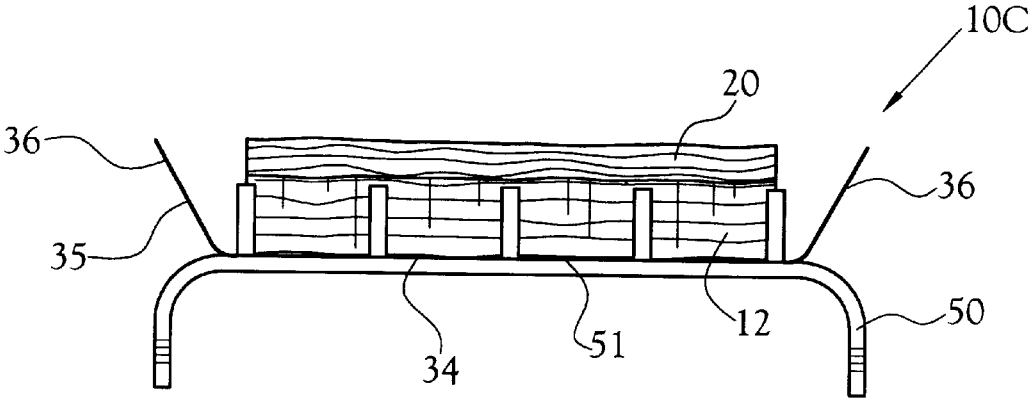
FIG. 5 a front view of an alternate embodiment of the fire log arrangement of the present invention.

In the alternate embodiment illustrated in FIG. 5, the fire log arrangement 10C includes a screen 35 with raised ends 36. More specifically, the screen 35 defines a middle portion 34 which rests on the support surface 51 of the grate 50 and two raised ends 36 which extend from either side of the middle portion 34. The raised ends 36 serve a purpose similar to that of the third and fourth logs 38, 42. Specifically, the raised ends 36 of the screen 35 contribute to the hopper-like design such that any fuel 54 resting on the raised ends 36 will be forced downward to the fire chamber 30 in the fuel space 28. Further, the raised ends 36 prevent fuel 54 from falling out the sides.

In the preferred embodiment, the fire log arrangement 10 is employed by arranging at least the first log 12 and the second log 20 on the support surface 51 of a fireplace grate 50 and placing the grate on a fireplace floor 52. It will be noted that the fire log arrangement 10 can be employed without the use of a grate 50. Kindling or starter combustible fuel 54 is loaded in the fuel space 28 and larger combustible fuel 54 such as wood logs are loaded on top. The kindling is lit to start a fire. As the wood logs begin to combust, the first log 12 and the second log 20 of the fire log arrangement 10 heat up. The first and second logs 12, 20 retain and reflect or radiate heat and influence a more complete combustion of the fuel 54 in the fuel space 28. Airflow 56 from below the grate 50 and through the burning fuel 54 and the heat reflected or radiated by the first and second logs 12, 20 combine to maintain intense heat in the fire chamber 30. The interior faces 14, 22, with the assistance of gravity, direct the combustible fuel 54 to the fire chamber 30 where the intense heat combusts the fuel 54 until all of the fuel 54 is consumed. Further, the interior faces 14, 22 along with gravity relieves one from the responsibility of tending or stoking the fire. Further, because of the more complete combustion of the fuel 54, a low or moderate fire can be maintained with as few as one or two sticks of wood, or a higher fire can be maintained with as few as three pieces of wood.

It will be noted that although wood has been referred to as the fuel to be combusted, any fuel that is appropriate for burning in a fireplace would be suitable for use with the fire log arrangement 10 of the present invention.

From the foregoing description, it will be recognized by those skilled in the art that a fire log arrangement 10 offering advantages over the prior art has been provided. Specifically, the fire log arrangement 10 can be used in conjunction with a combustible fuel source 54 such as wood. Further, the fire log arrangement 10 saves fuel by influencing complete combustion of the combustible fuel 54. Moreover, the fire log arrangement 10 is configured such that the requirement to stoke or tend the fire is minimal. Also, the fire log arrangement 10 creates the appearance of a full rack of logs burning in the fireplace while actually burning as few as one to three logs such that fuel consumption is more efficient. Additionally, the fire is completely surrounded by a non-flammable material. Furthermore, the screen 32 or 35 prevents large coals or unburned fuel 54 from falling into the ashes on the fireplace floor 52 before fully combusting.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

We claim:

1. A fire log arrangement comprising:

a first log defining an elongate configuration defining an upper terminal edge and a lower terminal edge along a length thereof, an interior face being defined between said upper terminal edge and said lower terminal edge and having a convex configuration, said lower terminal edge of said first log being positioned on a fire support, said first log being non-combustible and being configured to simulate a wood log;

a second log defining an elongate configuration defining an upper terminal edge and a lower terminal edge alone a length thereof, an interior face being defined between said upper terminal edge and said lower terminal edge and having a convex configuration, said second log being non-combustible and being configured to simulate a wood log, said lower terminal edge of said second log being positioned on said fire support and being spaced apart from said first log lower terminal edge such that a fuel space is defined between said first log interior face and said second log interior face and terminating at a lower limit on said fire support, said first log and said second log being oriented in a substantial parallel relationship one to another, said fuel space defining a fire chamber at a lower end thereof, said fuel space for receiving a combustible fuel, said first log interior face and said second log interior face being oriented such that said fuel space is non-diverging from said first log upper terminal edge and said second log upper terminal edge to said first log lower terminal edge and said second log lower terminal edge to form a funnel-type configuration to induce the combustible fuel to fall inward between said first log and said second log into said fire chamber, said fire support being configured to allow air to flow therethrough and between said first log and said second log into said fuel space, said fire support further being configured to retain substantially all unconsumed portions of the combustible fuel.

2. The fire log arrangement of claim 1 further including a screen which extends between said first log and said second log.

3. The fire log arrangement of claim 1 further including a third log and a fourth log, said third log positioned proximate a first end of said first log and a first end of said second log, said fourth log positioned proximate a second end of said first log and a second end of said second log.

4. The fire log arrangement of claim 3 wherein said third log defines an interior face, said fourth log defining an interior face, wherein said third log interior face and said fourth log interior face cooperate with said first log interior face and said second log interior face to induce the combustible fuel to fall inward between said first log and said second log.

5. The fire log arrangement of claim 3 wherein said third log and said fourth log are fabricated from a noncombustible material.

6. The fire log arrangement of claim 1 further including a screen defining a middle portion and two raised ends one each extending from opposing sides of said middle portion, said middle portion extending between said first log and said second log, said two raised ends cooperating with said first log interior face and said second log interior face to induce the combustible fuel to fall inward between said first log and said second log.

7. A fire log arrangement which rests on a support surface of a fireplace grate such that said fire log arrangement is suspended above a fireplace floor to establish an airflow in a direction from the bottom of the fireplace grate through said fire log arrangement, said fire log arrangement comprising:

a first log defining an elongate configuration defining an upper terminal edge and a lower terminal edge along a length thereof, an interior face being defined between said upper terminal edge and said lower terminal edge and having a convex configuration, said lower terminal edge of said first log being positioned on a fire support grate, said first log being non-combustible and being configured to simulate a wood log;

a second log defining an elongate configuration defining an upper terminal edge and a lower terminal edge along a length thereof, an interior face being defined between said upper terminal edge and said lower terminal edge and having a convex configuration, said second log being non-combustible and being configured to simulate a wood log, said lower terminal edge of said second log being positioned on the fireplace grate and being spaced apart from said first log lower terminal edge such that a fuel space is defined between said first log interior face and said second log interior face and terminating at a lower limit on said fire support, said first log and said second log being oriented in a substantially parallel relationship one to another, said fuel space for receiving a combustible fuel, said fuel space defining a fire chamber at a lower end thereof, said first log interior face and said second log interior face being oriented such that said fuel space is non-diverging from said first log upper terminal edge and said second log upper terminal edge to said first log lower terminal edge and said second log lower terminal edge to form a funnel-type configuration between said first log interior face and said second log interior face to induce the combustible fuel to fall inward between said first log and said second log into said fire chamber, said fire support being configured to establish an airflow therethrough and between said first log and said second log into said fuel space, said fire support further being configured to retain substantially all unconsumed portions of the combustible fuel, the airflow assisting in the induction of a thorough combustion of the combustible fuel in said fire chamber.

8. The fire log arrangement of claim 7 further including a third log and a fourth log, said third log positioned proximate a first end of said first log and a first end of said second log, said fourth log positioned proximate a second end of said first log and a second end of said second log.

9. The fire log arrangement of claim 8 wherein said third log defines an interior face, said fourth log defining an interior face, wherein said third log interior face and said fourth log interior face cooperate with said first log interior face and said second log interior face to induce the combustible fuel to fall inward between said first log and said second log.

10. A fire log arrangement which rests on a support surface of a fireplace grate such that said fire log arrangement is suspended above a fireplace floor to establish an airflow in a direction from the bottom of the fireplace grate through said fire log arrangement, said fire log arrangement comprising:

a first log defining an elongate configuration defining an upper terminal edge and a lower terminal edge along a length thereof, an interior face being defined between said upper terminal edge and said lower terminal edge and having a convex configuration, said lower terminal edge of said first log being positioned on a fireplace grate, said first log fabricated from a noncombustible material and being configured to simulate a wood log;

a second log defining an elongate configuration defining an upper terminal edge and a lower terminal edge along a length thereof, an interior face being defined between said upper terminal edge and said lower terminal edge and having a convex configuration, said second log being configured to simulate a wood log, said lower terminal edge of said second log being positioned on the fireplace grate and being spaced apart from said first log lower terminal edge such that a fuel space is defined between said first log interior face and said second log interior face and terminating at a lower limit on said fire support, said first log and said second log being oriented in a substantially parallel relationship one to another, said fuel space defining a fire chamber at a lower end thereof, said fuel space for receiving a combustible fuel, said second log fabricated from a noncombustible material, said first log interior face and said second log interior face being oriented such that said fuel space is non-diverging from said first log upper terminal edge and said second log upper terminal edge to said first log lower terminal edge and said second log lower terminal edge to form a funnel-type configuration between said first log interior face and said second log interior face to induce the combustible fuel to fall inward between said first log and said second log into said fire chamber, said fire support being configured to establish an airflow therethrough and between said first log and said second log into said fuel space, said fire support further being configured to retain substantially all unconsumed portions of the combustible fuel, the airflow assisting in the induction of a thorough combustion of the combustible fuel in said fire chamber; and, a screen resting on the support surface of the fireplace grate and extending between said first log and said second log.

11. The fire log arrangement of claim 10 wherein said screen defines a middle portion and two raised ends one each extending from opposing sides of said middle portion, said middle portion extending between said first log and said second log, said two raised ends cooperating with said first log interior face and said second log interior face to induce the combustible fuel to fall inward between said first log and said second log.

12. The fire log arrangement of claim 10 further including a third log and a fourth log, said third log positioned proximate a first end of said first log and a first end of said second log, said fourth log positioned proximate a second end of said first log and a second end of said second log.

13. The fire log arrangement of claim 12 wherein said third log defines an interior face, said fourth log defining an interior face, wherein said third log interior face and said fourth log interior face cooperate with said first log interior face and said second log interior face to induce the combustible fuel to fall inward between said first log and said second log.

* * * * *